United States Patent [19]

Graham, II

[11] 4,091,978

[45] May 30, 1978

[54] SHEET HANDLING APPARATUS

[75] Inventor: John Earl Graham, II, San Jose, Calif.

[73] Assignee: International Business Machines Corporation, Armonk, N.Y.

[21] Appl. No.: 739,396

[22] Filed: Nov. 8, 1976

[51] Int. Cl.[2] ..... B26F 3/02

[52] U.S. Cl. ..... 225/100; 83/94; 271/184

[58] Field of Search ..... 225/100; 83/89, 94; 271/80, 184, 213, 214, 223, 224, 273, 274; 355/6

[56] References Cited

U.S. PATENT DOCUMENTS

| | | | |
|---|---|---|---|
| 2,090,585 | 8/1937 | Waechter | 83/89 X |
| 2,158,727 | 5/1939 | Morrison et al. | 83/89 X |
| 3,630,607 | 12/1971 | Korn et al. | 271/213 X |
| 3,735,978 | 5/1973 | Turner et al. | 271/80 X |
| 3,994,487 | 11/1976 | Wicklund | 271/80 |
| 4,025,023 | 5/1977 | Moffitt | 225/100 |

FOREIGN PATENT DOCUMENTS

| | | | |
|---|---|---|---|
| 1,256,289 | 12/1971 | United Kingdom | 271/213 |

*Primary Examiner*—Frank T. Yost
*Attorney, Agent, or Firm*—Otto Schmid, Jr.

[57] ABSTRACT

Sheet handling apparatus including burster apparatus for separating continuous form webs into sheets and for feeding the just-burst sheets along a sheet path to a stacker mechanism where the sheets are stacked on end in the same order they were in the web. A plurality of feeding means is spaced along the sheet path and these feeding means are selectively actuated to feed any size sheet and as the sheets are fed along the sheet path, each sheet can be selectively laterally offset to a plurality of laterally separated positions to facilitate the separation of the sheets into sets of copies, data sets or jobs.

9 Claims, 9 Drawing Figures

SHEET HANDLING APPARATUS

BACKGROUND OF THE INVENTION

This invention relates to apparatus for handling continuous forms and sheets and more particularly to apparatus for separating continuous forms into sheets and selectively laterally offsetting sheets into a plurality of laterally separated sets as the sheets are fed along a sheet path.

A typical computer output printer operation sometimes has the requirement that the continuous forms (fan-fold) output be trimmed and separated into sheets and then further separated into sets of copies, data sets or jobs for distribution to customers and/or operating segments of the organization. This work has traditionally been done off line using a manually set up burster and trimmer and by manual separation of copies, data sets and jobs. As computer output printers have been developed which operate at higher and higher printing speeds, the post-printing processing of the printed output has become more of a problem in achieving the throughput the printer is capable of producing. For this reason it would be desirable to perform these operations on line in the printer. Co-pending application Ser. No. 627,740 filed Oct. 31, 1975 entitled "SHEET HANDLING APPARATUS" by Harold P. Wicklund now U.S. Pat. No. 3,994,487 discloses a system for performing the post-printing operations on line in a printer for a number of predetermined sheet lengths.

It is the purpose of this invention to provide a universal apparatus for on-line separation and distribution of any size continuous forms output from a high speed computer printer without interruption of continuous running of the printer.

SUMMARY OF THE INVENTION

Briefly, according to the invention, there is provided handling apparatus comprising a burster and a plurality of a selectively actuable sheet feeding means spaced along a predetermined path including offset feeding means for selectively moving a predetermined sheet to a laterally offset position in response to an electrical control signal as the predetermined sheet is moved along the sheet path. Control means are provided to generate signals in accordance with the length of the sheet being processed to control bursting and selectively provide a plurality of offset positions for all sizes of sheets moving along the sheet path so that the sheets can be separated into a plurality of laterally separated sets.

DETAILED DESCRIPTION OF THE PREFERRED EMBODIMENT

Figure 1:
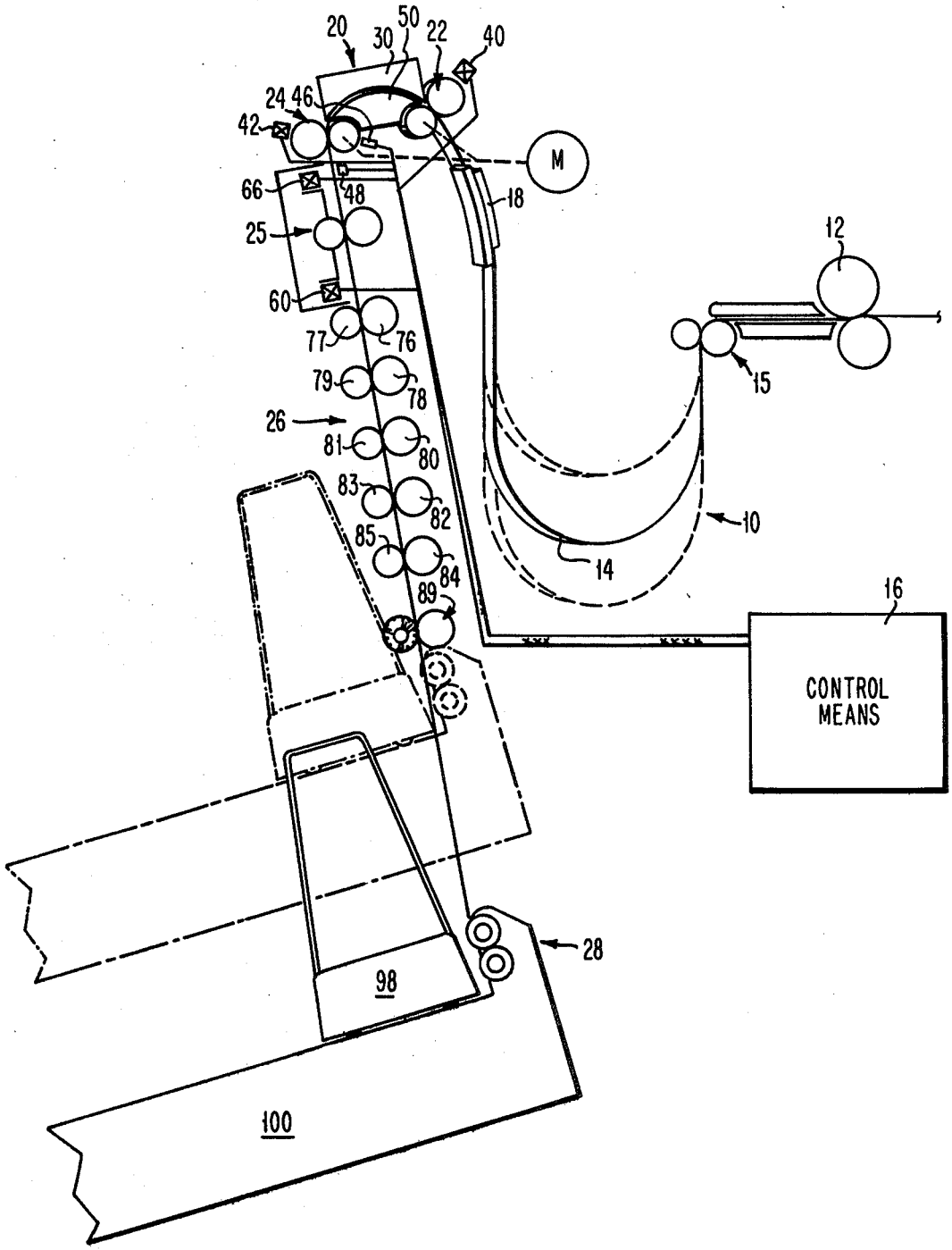
FIG. 1 is a schematic front view of a web processing system embodying the present invention.

The invention will be described as a part of a post processing system for operation on-line with a computer output printer. However, it will be obvious to those skilled in the art that this sheet handling apparatus has characteristics which will render it usable in a wide variety of applications.

The continuous form web 10 from the printer is fed through suitable guides to trimmer apparatus 12. The trimmer apparatus functions to trim by means of two coacting rotary knives the trim strip of either side of the web which carries the tractor holes which may have been used to feed the web up to this point. The trimmed web is then guided into a buffer loop 14. The function of the buffer loop is to decouple the post processing apparatus from the printer, since the post processing apparatus runs at a faster rate. Scuff rolls 15 are driven at a faster speed than web 10 and these rolls slip on web 10, thereby establishing the buffer loop as fast as the web 10 comes from the associated printer. When a maximum loop has been established, the post processing apparatus is run until some minimum loop results, at which time the process stops. The process is repeated when the maximum loop is again reached. The loop is adjusted for a given length during thread-up so that control means 16 can use this information along with the known length of forms being printed, to keep track of individual printed sheets in the web through the post processing operation.

From the buffer loop the web proceeds through steering means 18 to burster apparatus 20 by means of first feeding means 22 which is driven at a speed slightly in excess of the nominal printer speed. Bursting is accomplished by second feeding means 24 which is selectively actuated for feeding the web at a speed substantially faster than the first speed so that the sheet is separated along the transverse preweakened line. The burst sheets are fed along a sheet path by sheet handling apparatus 26 to a suitable sheet receiving means 28. An offset station 25 is provided along the sheet path between burster apparatus 20 and sheet handling apparatus 26 to selectively give a sheet a lateral component of motion while maintaining the same forward component of velocity along the sheet path. To produce offset of a sheet, it is necessary for the control unit to keep track of the sheet throughout the sheet path so that the offset station can be actuated at the appropriate time to offset that particular sheet.

Burster apparatus 20 is arranged around a curved web path and the distance along the curved web path between feeding means 22 and feeding means 24 is chosen in relation to the length of the shortest sheets to be processed. Thus, when processing short sheets, the burster feeding means 24 remains engaged and separation of the web into sheets is accomplished in a continuous operation. However, for sheets longer than some minimum length, a control signal is provided to control bursting at the appropriate time for the sheet length being processed. The control signal is provided by control means 16. Control means 16 may comprise hard wired control circuits designed to produce the desired control functions. Alternatively, control means 16 may comprise signals generated from programmed instructions from the data processing system of which the printer is a part.

A curved guide member 30 is positioned between input feeding means 22 and burster feeding means 24 to define the outer boundary of the curved web path. Feeding means 22, 24 are selectively actuated by an electrical control signal from control means 16 to the respective operating magnets 40, 42. Magnet 40 is actuated by a signal from control means 16 to activate first feeding means 22 and feed the web squarely into this feeding means. A bend or "buckle" is formed as the web is forced to follow the curvature of guide member 30 and the curvature of guide member 30 is designed so that the web is also fed squarely into second feeding means 24. A BURST signal is produced by control means 16 at the appropriate time for bursting the sheet size being processed. The sheet size being processed is indicated at the start of a printing job by any suitable means such as by the operator actuation of a pushbutton on the control panel for example and the control unit utilizes this information to generate the BURST signal at the appropriate time.

In the embodiment shown in the drawings, the means for generating the burster control signal comprises sheet position sensor means 48 and displacement indicating signal means 46 which functions to produce a series of electrical control pulses the frequency of which is proportional to the speed of the web along the sheet path. The number of these control pulses then is proportional to the displacement of the web past feeding means 22. In the embodiment shown, displacement indicating signal means 46 comprises an emitter which is coupled to the same shaft as the burster feed roll. The emitter comprises a circular member having a plurality of spaced teeth members on its peripheral surface. When one of the teeth members is aligned with a magnetic pickup member, a low reluctance path is established and an electrical pulse is produced in the pickup circuit. In the embodiment shown, sheet position sensor means 48 comprises a photodetector mounted adjacent the web path near feeding means 24 and a light source mounted adjacent the detector. When the leading edge of the web comes to the light source and detector, a signal is generated which signifies to the control means that the web has arrived at a known position. The light and photocell could also be mounted so that the web comes between them to generate the signal. The edge detector signal is used to set a count into a counting means corresponding to the predetermined number for that sheet length. Pulses from emitter 46 are gated to decrement the counting means. When the count reaches a predetermined constant, a signal is generated to energize magnet 42 to engage second feeding means 24, thereby initiating bursting.

Figure 2:
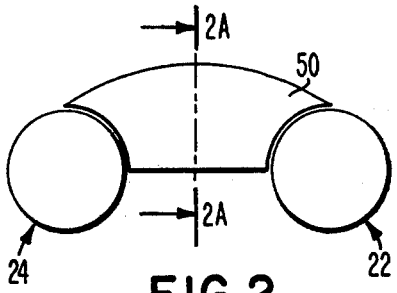
FIG. 2 is a partial view of burster apparatus 20.
Figure 2A:
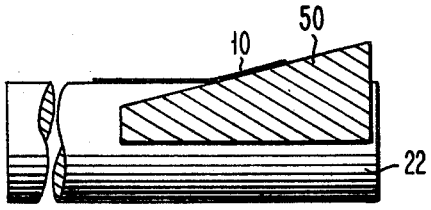
FIG. 2*a* is a partial section along lines A—A of FIG. 2.

In the embodiment of the burster apparatus shown in FIG. 2, a stress equalizer member 50 is provided along one edge of the sheet path between feeding means 22, 24. Stress equalizer 50 has curvature along the sheet path so that the stress is equalized along that edge of the sheet so that the separation will commence at the weakest point in the web, that is the perforation between sheets. The stress equalizer member 50 is particularly important for the short sheets since bursting for the short sheets is a continuous operation and the position of the perforation may be any point between feeding means 22, 24. As shown in FIG. 2*a*, the stress equalizer member 50 has a slope along the width of the web, and at all points along its length the curvature of member 50 is tangent to the driven rolls comprising feeding means 22, 24.

To produce offset of a sheet, it is necessary for the control unit to keep track of the sheet throughout the sheet path so that the offset station can be actuated at the appropriate time to offset that particular sheet. The offset station 25 is positioned in the sheet path between burster apparatus 20 and sheet handling apparatus 26. The offset station comprises selectively actuable feeding means that are actuated at the appropriate time to transport the sheets from the burster to the sheet handling apparatus in two different modes. One mode is in response to a STRAIGHT ahead signal from control means 16 which provides positive control over the sheet motion to keep it moving along the sheet path at the selected post-burst velocity. The second mode is in response to an OFFSET signal from control means 16 which provides positive control at the same velocity in a forward direction as the straight through operation but also adds a lateral component of motion so that the sheet is laterally displaced as it is fed through the offset station. This is important to the operation since any lessening of the forward velocity would permit a later sheet to "catch up" with a sheet being offset and lead to sheet jams or other problems along the sheet path. It is an added feature of this invention that a plurality of different offset positions are selectable in response to signals from control means 16.

Figure 3:
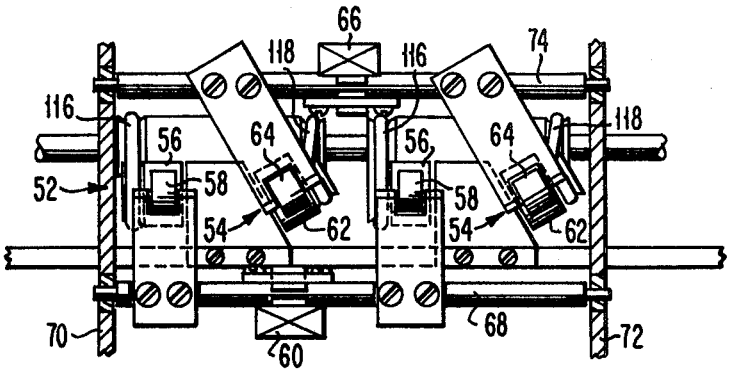
FIG. 3 is a view showing the offset station.

The offset station comprises one selectively actuable feeding means 52 (see FIG. 3) for feeding sheets straight through and another selectively actuable feeding means 54 for selectively giving the sheets a lateral displacement as the sheets are fed along the sheet path. The feeding means 52 comprises a set of two continuously running rolls 56 and co-operating with these rolls are two pressure rolls 58 selectively actuable by a STRAIGHT ahead signal to control magnet 60. Offset feeding means 54 comprises a set of two continuously running feed rolls 62 set at an angle to the sheet path and the velocity along the sheet path is related to the offset roll velocity by the tangent of the angle. When the cooperating pressure rolls 64 are actuated by OFFSET signal to control magnet 66, a lateral component of motion is provided while maintaining the same forward component of velocity as the other two straight ahead rolls 56. In the embodiment shown, straight ahead pressure rolls 58 are mounted on pivot shaft 68 which is journaled between side plates 70, 72. Offset pressure rolls 64 are mounted on pivot shaft 74 which is also journaled between side plates 70, 72.

In the embodiment shown, sheet handling apparatus 26 comprises a plurality of feeding means, each including a constantly running feed roll in nip forming relationship with a selectively actuable pressure roll. The feeding means are spaced along the sheet path in position to each feed any size sheet within the chosen design limits. In the embodiment shown, these rolls sets are spaced at 3, 5, 7, 9 and 11 inches from the offset station. Sheet receiving means 28 is at the end of the sheet path formed by the feeding means and it is adapted to receive the sheet serially in the same order that they are printed.

The sheet handling apparatus 26 comprises in the embodiment shown in the drawings a number of constantly running feed rolls 76, 78, 80, 82, and 84 suitably mounted between end members 86, 88. A guide member 90 is fixedly mounted between end members 86, 88 adjacent feed rolls 76, 78, 80, 82 and 84 with openings for feeding engagement with sheets moving along a path between guide members 90, 92. Guide member 92 comprises a similar guide means for mounting corresponding pressure rolls 77, 79, 81 83 and 85 so that they are biased by means of spring means 94 toward engagement with the feed rolls. Guide member 92 is pivotally mounted at the bottom relative to guide member 90 so that these guide members can be separated for easy access to the sheet path.

In the embodiment shown, sheet receiving means 28 comprises a fixed guide member (not shown) which extends substantially in line with the sheet path. The sheets are driven into the sheet stacker 28 on end between the fixed guide member and backstop member 98 down to stacker bed member 100. Backstop member 98 is fixed at a small angle to the vertical so that a component of gravity tends to make the top of the sheet lean away from the entry point. In addition, the stacker bed 100 is positioned at a small angle to the horizontal. The sheets abut backstop member 98, and backstop 98 moves back as the stack accumulates against the pressure supplied by a constant force spring member. The force of this spring returns the backstop against the residual stack as quantities of sheets are removed from the stacker by hand. The backstop is tilted back a few degrees from the position of the fixed guide member so that a relatively narrow throat for entry of the first sheet is provided.

The vertical position of the stacker bed 100 is set to receive the length of sheet being processed. This is accomplished by the operator by moving the stacker bed to detented positions by setting means 120 for each sheet length or by mechanism designed to produce this movement to a detented position in response to a signal from control means 16. An adjusting means is operable in response to setting the position of the stacker to also selectively actuate the sheet handling means 26 for feeding the selected size sheets along the sheet path. In the embodiment shown in the drawings, adjusting means comprise linear cam means 102 which is attached at one end to stacker bed 100 and is mounted for sliding motion on end members 86, 88 in accordance with the stacker bed position. Linear cam means 102 is mounted adjacent bell crank members 104 so that the high point of cam 102 engages an arm of the bell crank means and pivots the member so that the other arm of the bell crank member 104 engages the shaft on which the pressure rolls are mounted and moves them against the bias of spring 94 out of engagement with the respective drive roll. For example, when the stacker bed 100 is in the up position to process 3 inch long sheets, then all the feed rolls 76, 78, 80, 82 and 84 are engaged with their pressure rolls 77, 79, 81, 83 abd 85. When bed 100 is lowered to the position to process 5.5 inch long sheets, cams 102 lift the drive roll 76 out of engagement with its pressure roll 77 and so on until the stacker bed is at its lowermost position for 12 inch long sheets in which case only feeding means 84 and 85 is engaged.

Figure 4:
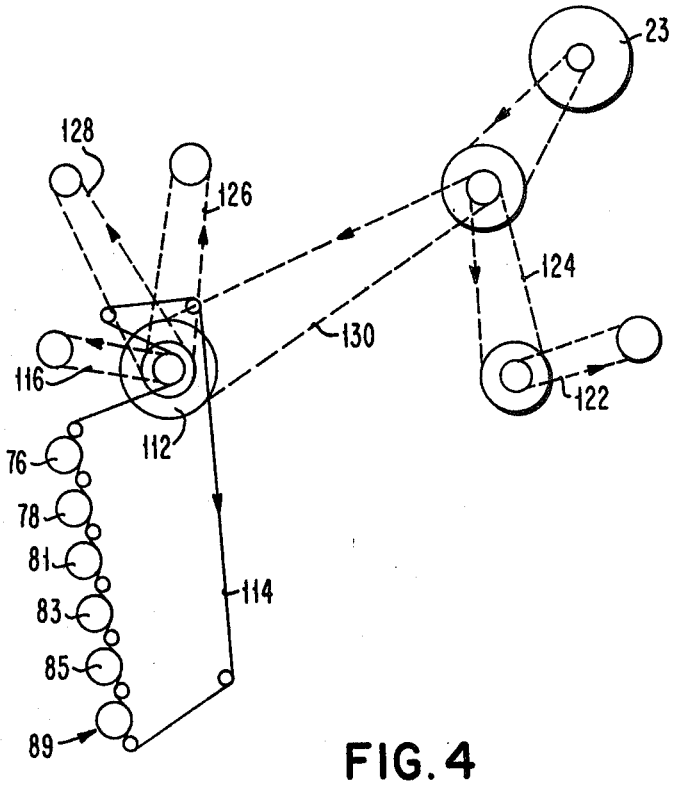
FIG. 4 is a diagrammatic view showing the drive belt arrangement for the sheet handling apparatus.

The components of the sheet handling apparatus are driven by suitable belts or gears from a suitable drive motor. In the embodiment shown (See FIG. 4) motor 23 provides the motive force for the components of the system. Suitable timing belt drives are provided (shown dashed in the drawings) with pulleys sized to provide the appropriate speed for the trimmer apparatus 12 by belt 122, the scuff rolls 15 by belt 124, first feeding means 22 by belt 126, second feeding means 24 by belt 128 and pulley means 112 by belt 130. A flat belt drive 114 is provided from pulley means 112 to drive sheet handling apparatus 26. An "O" ring drive 116 is provided to the straight ahead drive rolls 56. An "O" ring drive 118 (See FIG. 3) is also provided to offset drive rolls 62. This drive is to a smaller pulley so that rolls 62 are driven at a higher velocity than rolls 56. This higher velocity permits rolls 62 to drive the sheets at the same forward velocity as rolls 56.

In accordance with a specific embodiment of the invention, a specific example for control of the sheet handling apparatus will be described for all sheet lengths between 3 and 12 inches. Control of the apparatus is different for the short length sheets (3 to 4 inches in the specific example) and other sheet lengths. Operation is basically continuous for the short length sheets and for other sheet lengths the bursting is timed for the sheet length being processed. Control of the timing for the burster operation is accomplished by counting means 35, 36 in conjunction with two register means 33, 34 and storage means 32. A specific example of the overall operation will now be given for the 3 inch length and the 8.5 inch length which is illustrative of all the remaining lengths.

For the 3 inch length, the apparatus is designed to handle this minimum length so continuous operation of the burster is possible in this case. Bursting is accomplished by feeding means 24 running at a higher rate than feeding means 22. As the leading edge of the sheet to be burst emerges from the burster output feeding means 24, it is guided to the offset station, the pinch point of which is 3 inches from the pinch point of feeding means 24. Thus, as the trailing edge is leaving feeding means 24, the leading edge is entering offset station 25. The straight ahead rolls 58 are engaged prior to the end of the bursting operation in readiness to feed the sheet along the sheet path. Sheet position sensing means 48 is located along the sheet path between burster feeding means 24 and the offset station. When the leading edge of the sheet passes the detector means 48, a signal LEADING EDGE is generated. This signal designates that the sheet is in a predetermined position and this fact is used by the control unit to schedule subsequent events relative to that sheet such as the decision to offset, for example. If a sheet is to be offset, a signal is generated by the control unit at the appropriate time. At this point in time, the control unit decision to offset is executed. If there is no signal to offset, the straight ahead rolls remain engaged as the sheet is fed along the sheet path. If an OFFSET signal is received for control means 16, then straight ahead rolls are disengaged by de-energizing magnet 60 simultaneous with the action of energizing magnet 66. This action causes the offset rolls to be engaged to give the sheet a lateral component of velocity for a specified displacement as determined by the control unit. The 3 inch drive roll 76 is located 3 inches from the offset station so, when the offset rolls 64 are lifted, the leading edge is simultaneously caught by driving means 76 so that the sheet will remain under positive control and will again be driven straight ahead through the other feeding means and into the sheet stack which is set with the stacker bed approximately 3 inches from stacker entry feeding means 89.

Figure 5:
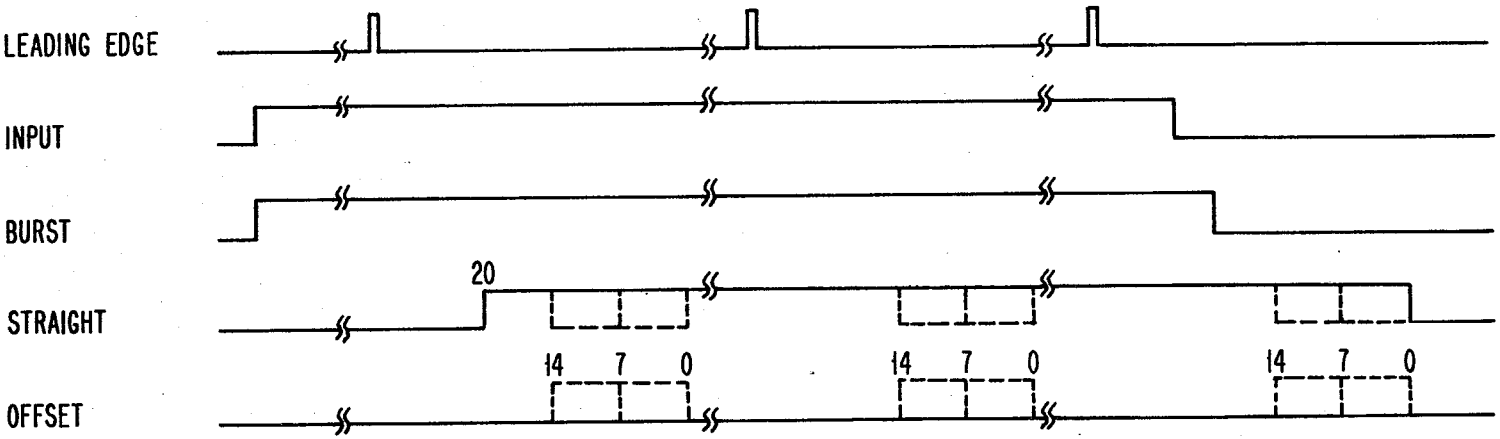
FIG. 5 is a timing diagram showing the relative times at which components are actuated to control the sheet separation and distribution operation for short length sheets.

The timing for control of the various operations for processing short sheets is shown in FIG. 5. When processing 3 inch sheets, the operation is continuous and starts in response to a PROCESS signal from control means 16. A count of 53 is set into register means 33 and magnet 40 is energized to energize input feeding means 22. The web is present between the rolls of feeding means 22 from the initial thread-up operation or from a previous burst operation so closure of the rolls starts the feed of web 10 through the burster apparatus. A signal BURST is also generated at this time and sent to magnet 42 to energize burster feeding means 24. Feeding continues until one of two events occur.

The first possibility is that the counter which is decremented by pulses from emitter 46 reches zero before the leading edge of the web reaches sensor means 48 and in this case an error is indicated and feeding is stopped. The count of 53 would normally provide sufficient time for the leading edge of the web to be fed to sensor 48, so the failure to arrive within that time indicates either a jam along the web path, that the control unit 16 has lost synchronism with the sheets forming web 10 or some other malfunction.

Figure 6:
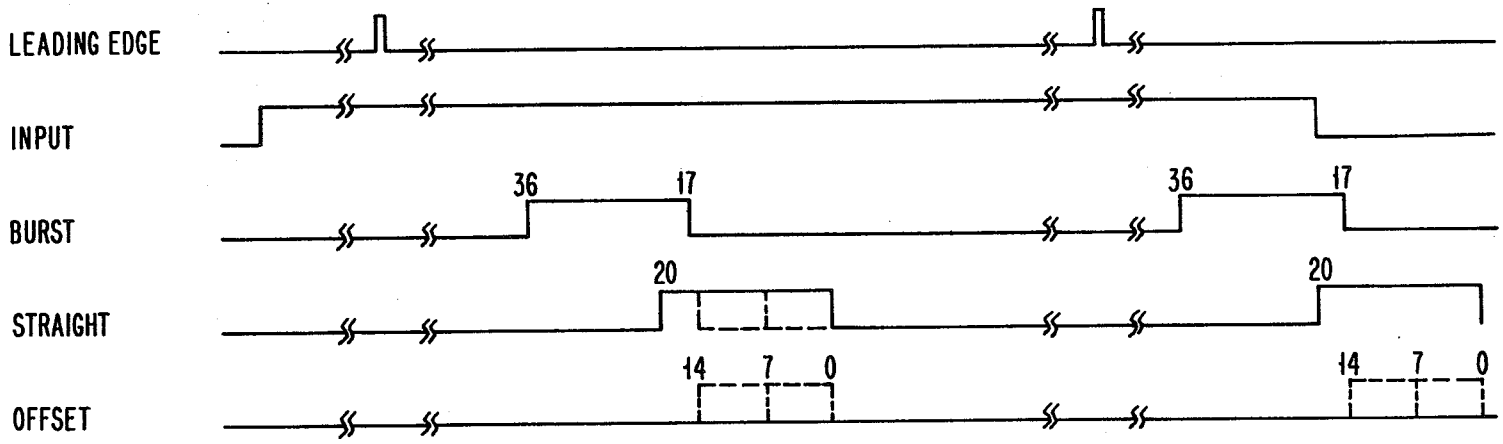
FIG. 6 is a timing diagram showing the relative times at which various components are actuated to control the sheet separation and distribution operation for other length sheets.

The second possibility is that the leading edge of the web reaches sensor 48 before the counter reaches zero. A LEADING EDGE signal is generated as a result and this signal is sent to the control means. A count of 32 is placed in register means 33 and a count of 33 is placed in register means 34. The burster operates on a continuous basis so long as additional sheets are to be processed. An offset 1 decision is made at count 14 of counting means 36 and this is shown dotted since this is a selective function. The offset 2 decision is made at count 7 of counting means 36 and either offset is terminated at count 0. An error check is made at count 0 of counting means 35 to determine whether sensor 48 is uncovered since at this time the trailing edge of the just-burst sheet should have cleared the sensor. If not, this means that the sheet was not burst or that the control unit has lost synchronism with the web movement. As can be seen by reference to FIG. 6, for the last sheet the input rolls are opened at count 20 of counting means 35 and the burster rolls are opened at count 17. This leaves the end of web 10 between input rolls 22 in position for further operation.

Now, considering the 8.5 inch length for example, as the sheet is driven through the burster, the burster rolls will be open and as the leading edge of the sheet passes sensor means 48, the signal LEADING EDGE will be generated, and this signal will cause a count of 73 to be set in counting means 35, and a count of 71 to be set in counting means 36. Counting means 35, 36 are counted down in response to pulses from emitter 46 and when counting means 35 reaches a count of 36 it will cause the burster rolls 24 to close to initiate bursting. When the count in counting means 35 reaches 17 then burster rolls 24 are opened. The straight ahead rolls of the offset station are closed at count 20 of counting means 35 so that these rolls are feeding the sheet along the sheet path when the burster rolls are opened. The decision is made whether or not to offset this sheet prior to the time the count in counting means 36 reaches 14 in response to a signal from the control unit. In the event that offset is selected the offset rolls are closed at count 14 and the offset operation is accomplished in the same manner as in the 3 inch length example. The offset rolls are opened when the count in counting means 36 reaches zero. At this point in time, the leading edge of the sheet will have traveled through drive rolls 76, 78 which were disengaged because of the linear cam 102 attached to stacker bed 100, which was set to the 8.5 inch stacker position. The leading edge is then caught in the feeding means 80, 81 and again driven straight ahead through the feeding means 82, 83 and 84, 85 into the stacker 28. All other length sizes operate similarly.

Figure 7:
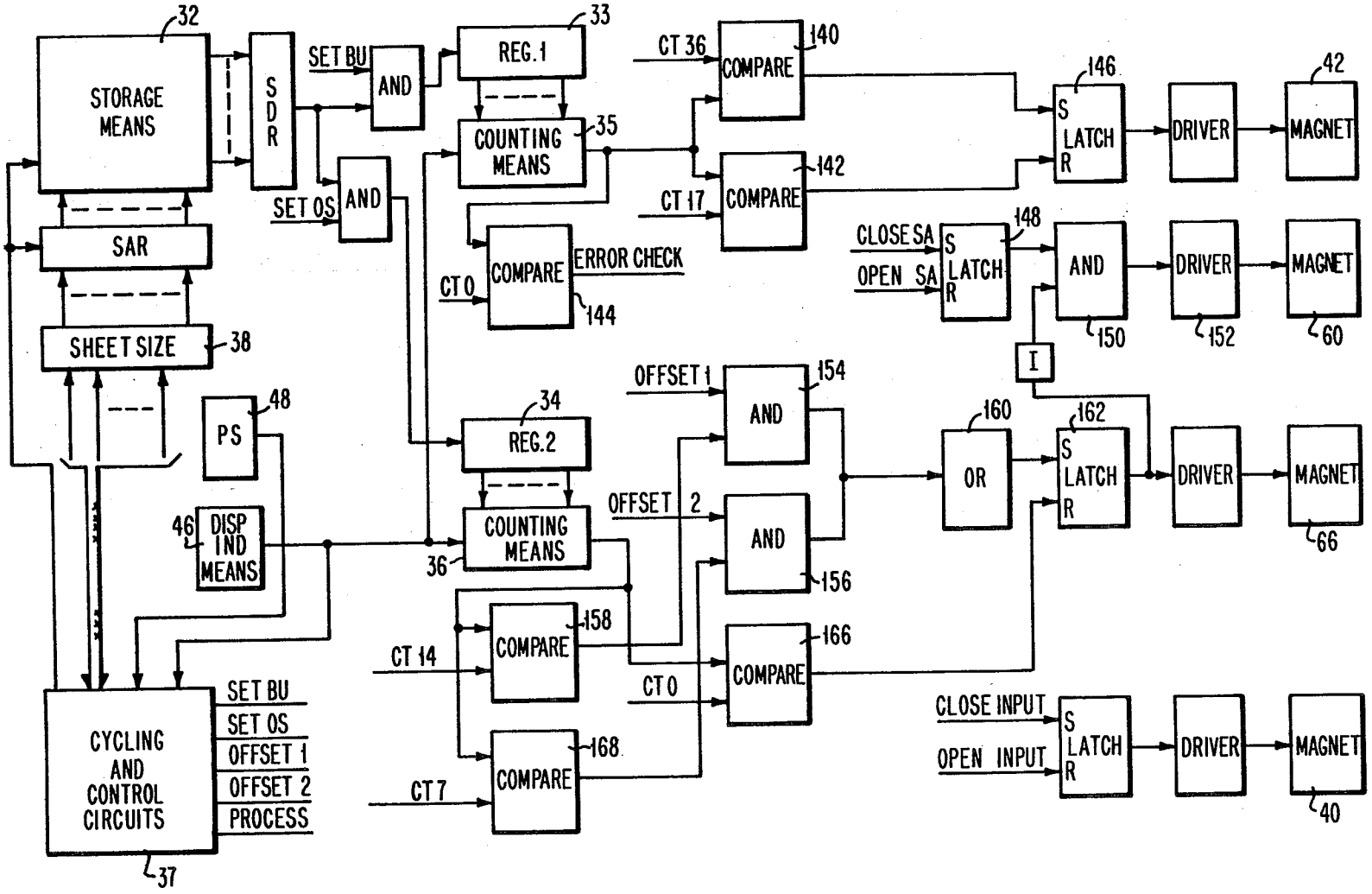
FIG. 7 is a schematic block diagram of a specific embodiment of the control circuits for some operations the sheet handling apparatus.

Control of the burster for some sheet lengths is shown in FIG. 7. In response to a PROCESS signal from control means 16, a count of 53 is set into counting means 35 and magnet 40 is energized to close input feeding means 22. The web is present with part of the web extending beyond input feeding means 22 from the initial thread-up operation or from a previous burst operation so closure of the rolls starts the feed of web 10 through the burster apparatus. Under normal operation, the leading edge of the web reaches sensor 48 before the counter reaches zero. A LEADING EDGE signal is generated as a result and this signal is sent to the control means and functions as a reset signal for all control means.

TABLE I

| SHEET LENGTH | BURST | OFFSET |
|---|---|---|
| 3,3½,4 | 32 | 33 |
| 5½ | 45 | 49 |
| 6 | 49 | 51 |
| 7 | 59 | 67 |
| 8 | 68 | 70 |
| 8½ | 73 | 71 |
| 10 | 87 | 78 |
| 11 | 96 | 104 |
| 12 | 106 | 107 |

Table I comprises the counts stored in storage means 32 for a number of standard size sheets for a specific design of the apparatus embodying the invention. The values in the table are read out from storage in response to the LEADING EDGE signal and the specific values are accessed in response to the sheet length indicating means 38. The count stored in the BURST column is gated to register means 33 and the count stored in the OFFSET column is gated to register means 34. As the web is fed, counting means 35 and 36 decrement respective registers until a predetermined count is reached. At count 36 in counting means 35 a signal BURST is produced and sent to magnet 42 to close burster feeding means 24. The burster operates as previously described and at count 17 the BURST signal goes down and feeding means 24 are opened. An error check is made at count 0 of counting meabs 35 to determine whether sensor 48 is uncovered and, assuming normal operation, the trailing edge of the just-burst sheet should have cleared the sensor by this time.

Figure 8:
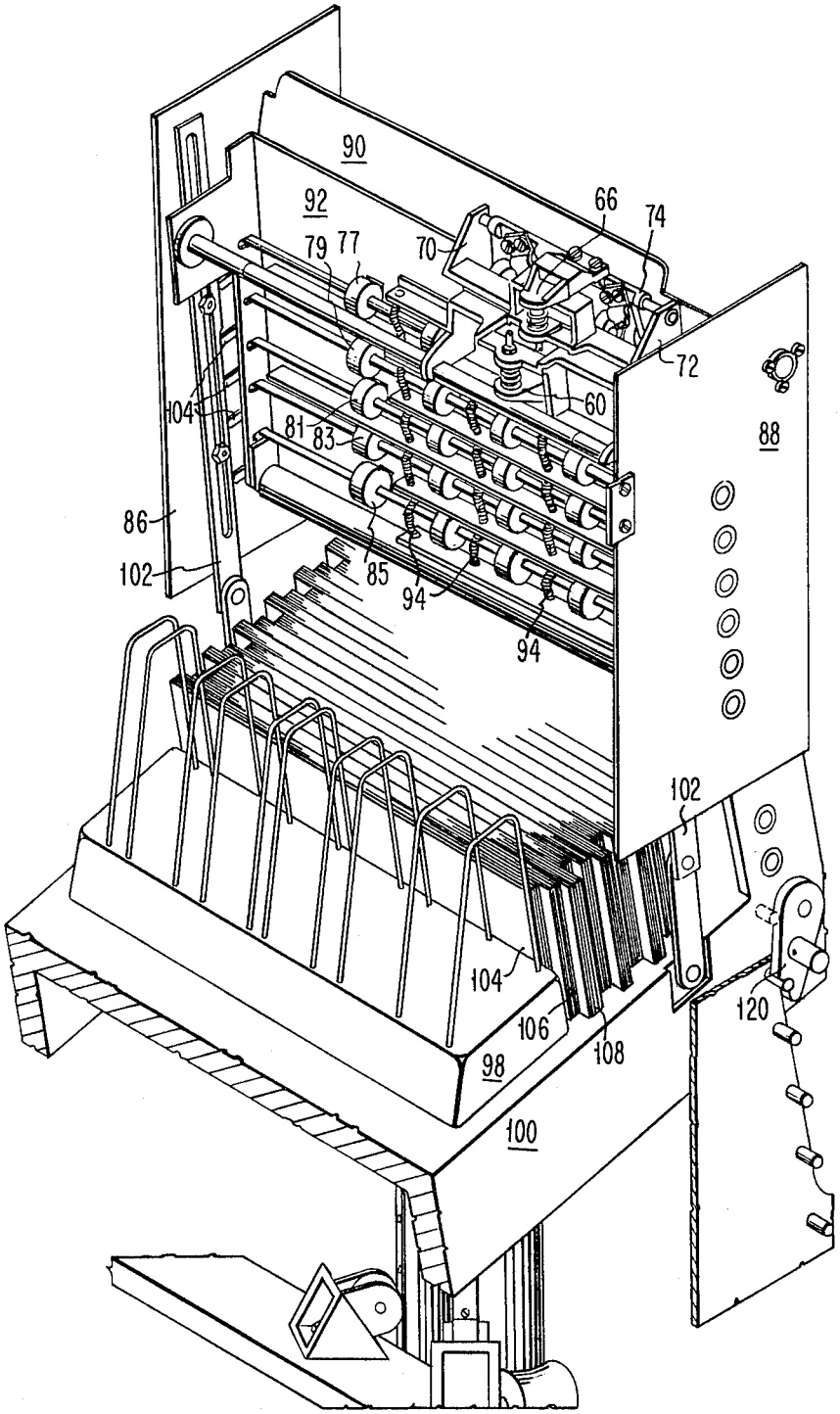
FIG. 8 is an isometric view of the sheet handling apparatus.

If offset of that sheet is to occur, an appropriate signal OFFSET 1 or OFFSET 2 is produced by control means 16. The OFFSET 1 signal is utilized at count 14 of counting means 36 to close the offset feeding means by energizing magnet 66. OFFSET 1 produces the largest offset of the sheet and an intermediate value of offset is produced by the offset 2. If OFFSET 2 is called for, this occurs when the count in counting means 36 reaches 7. The offset operation ends for both OFFSET 1 and OFFSET 2 at count zero of counting means 36 and offset feeding means are opened at this time. The sheets according to this control can be seen in FIG. 8 in which one set of sheets 104 has not been offset, one set of sheets 108 has been offset in response to an OFFSET 1 signal, and one set of sheets 106 has been offset in response to an OFFSET 2 signal.

The control unit 16 is designed to provide universal control over the sheets in web 10 regardless of the size of the sheets or whether this sheet size is a recognized standard size. In addition, the control unit provides a selection of one out of a plurality *n* of laterally offset sheet positions as the burst sheets are moved toward a utilization device so that the sheets can be separated into a plurality of different sets of copies, data sets or jobs.

To provide on-line control of the sheets in web 10, the control unit 16 operates in response to the sheet-length indicating signal to generate control signals to initiate bursting, to initiate offset and to terminate offset.

In the embodiment of control unit 16 shown in the drawings, storage means 32 is provided to store certain control information about each of the sheet sizes to be processed. The information is contained in a table stored in storage means 32 and this table is accessed by the sheet-length indicating signal. The table includes factors relating to the time for initiating bursting, the time for initiating offset, and the offset duration for each of the *n* offset positions.

Table I shows an example of the values stored in storage means 32 for a number of standard size sheets. Note that the sheet sizes do not have to be standard sizes but can be any size within the design limits of the sheet handling apparatus. The values in the table represent factors related to sheet displacement relative to the mechanical components of the sheet handling apparatus.

The factors in the table are accessed in response to a LEADING EDGE signal. This signal and the signal from sheet size indicating means 38 causes the factor to be read out from storage means 32. The data from storage means 32 comprises two bytes. One of the bytes stores the burst count data and this byte is stored in first register means 33. The byte relating to offset is stored in second register means 34. This data is transferred in parallel to the associated first counter means 35 for the burst data and to second counter means 36 for the offset data.

Pulses from displacement indicating means 46 are directed to counting meand 35, 36. When the appropriate number of pulses are counted by counting means 35, a signal is generated to begin the bursting operation. The burst rolls are kept closed for a time sufficient for the burst to be completed for the widest sheet to be processed. The straight ahead rolls 52 are energized prior to completion of the bursting operation by a signal CLOSE SA from control means 16 so that the just-burst sheet will continue along the sheet path at the post-bursting velocity.

A decision of whether to offset the just-burst sheet must be made by the control means and, if so, which of the plurality of offsets the sheet is to receive. In the embodiment shown, if offset is to occur, a signal OFFSET 1 or OFFSET 2 as appropriate is generated prior to the time counting means 36 reaches the offset count. The appropriate signal is used to close the offset rolls 54 and open straight ahead rolls 52 at the proper time and for the appropriate duration to produce the designated offset for that sheet. The offset rolls are opened when counting means 36 goes to zero. In the embodiment shown, counting means 35,36 are count down counters and the counters are counted down by pulses from displacement indicating means 46. The beginning of the burst operation is signified when the counts in counting means 35 equals the chosen burst count. When this occurs, as determined by comparing the chosen burst count and the current count in counting means 35 by compare circuit 140, a signal is generated on an equal compare and this output sets latch 146 to energize burst magnet 42. Compare circuit 142 is used to control the duration of the burst operation by comparing the predetermined count set into this compare circuit with the count in counting means 35 and a count corresponding to the set count terminates the bursting operation by resetting latch 146. Compare circuit 144 is used to determine when the count in counting means 35 reaches zero so that an error check can then be made. Prior to the termination of the bursting operation, control means 16 generates the signal CLOSE SA, which is coupled to set latch 148, the output of which is coupled through AND circuit 150 and driver 152 to energize straight ahead control magnet 60.

The means for controlling the offset operation in the embodiment shown comprises counting means 36, AND circuits 154 and 156; and compare circuits 158, 166 and 168. When counting means 36 initially reaches the selected count, if offset is to occur for that sheet, the signal OFFSET 1 or OFFSET 2 will be present. If OFFSET 1 is ON then AND circuit 154 is conditioned when the output from compare circuit 158 indicates that the selected count has been reached and the output is coupled through OR circuit 160 to set latch 162. The output of latch 162 is coupled to energize offset control magnet 66 and is also coupled through inverter 164 to decondition AND circuit 150 and open the straight ahead rolls.

In case the OFFSET 2 signal is present, AND circuit 156 is conditioned when the count (7 in the specific example) in counting means 36 defines the displacement for the second offset distance. When counting means 36 reaches this count, as sensed by compare circuit 168, AND circuit 156 is conditioned to set latch 162 to initiate the offset operation as previously described. The paper sheet displacement for ending the offset operation is sensed by compare circuit 166. An equal compare output from this circuit is coupled to reset offset latch 162 to terminate the offset operation.

While the invention has been particularly shown and described with reference to a preferred embodiment thereof, it will be understood by those skilled in the art that various changes in the form and details may be made therein without departing from the spirit and scope of the invention.

What is claimed is:

1. A universal job separation and distribution system for sheets separated from a continuous form web comprising:

selectively actuable bursting means for separating sheets from a continuous form web;

means for producing a signal corresponding to the sheet length in the web;

first selectively actuable feeding means for feeding the burst sheets straight ahead along the sheet path at a predetermined velocity;

second selectively actuable feeding means for feeding the burst sheets laterally as they move along the sheet path while maintaining the predetermined velocity along the sheet path;

control means responsive to the sheet length signal for providing a first control signal denoting the relative time for initiation of a bursting operation, a second control signal denoting the relative time for energization of said second feeding means, and a third control signal denoting the duration of said energization;

means under control of said first control signal to selectively actuate the bursting means and said first feeding means at the relative time defined by said signal;

means under control of said second control signal to selectively actuate said second feeding means and selectively deactuate said first feeding means at a relative time defined by said second control signal to initiate an offset operation; and means for de-energizing said second feeding means and to energize said first feeding means in response to said third control signal to produce a predetermined offset to provide lateral separation of sheets into different groups.

2. The apparatus according to claim 1 wherein said second feeding means comprises roll feeding means mounted at an angle to said sheet path and driven at a speed substantially faster than said predetermined velocity so that said sheet is laterally offset along said sheet path while its speed along the sheet path equals the predetermined velocity.

3. The apparatus of claim 1 wherein said bursting means comprises means for producing equal stress along one edge of the web during operation of said bursting means.

4. The apparatus of claim 1 additionally comprising means for selectively energizing said second feeding means at a plurality of predetermined lateral sheet displacements along the sheet path to provide lateral separation of sheets into a plurality of different groups, each group having a different lateral separation.

5. Appparatus for transporting sheets along a predetermined path at a predetermined velocity comprising:

means for producing an indicia of sheet length being processed;

a selective actuable feeding means for feeding sheets straight ahead along said path;

selectively actuable means for producing a lateral displacement of said sheet as it is moved along said path at the predetermined velocity;

control means operable in response to said sheet length indicia for generating a first control signal denoting the relative time for energization of said means for producing a lateral displacement of said sheet and second control signal denoting the duration of said energization;

means for energizing said lateral displacement producing means in response to said first control signal to initiate an offset operation; and means for de-energizing said lateral displacement producing means in response to said second control signal whereby a predetermined degree of offset is produced as said sheet is fed along said path.

6. The apparatus of claim 5 wherein said means for selectively producing a lateral displacement comprises a driven feed roll and a pressure roll mounted for selective movement to a nip-forming engagement with the feed roll and wherein said means for selectively actuating said lateral displacement comprises means for actuating said pressure roll.

7. The apparatus according to claim 6 wherein said means for producing a lateral displacement comprises roll feeding means mounted at an angle to said sheet path and driven at a speed substantially faster than said predetermined velocity so that said sheet is laterally offset along said sheet path while its speed along the sheet path equals the predetermined velocity.

8. The apparatus according to claim 5 wherein said means for producing a lateral displacement comprises roll feeding means mounted at an angle to said sheet path and driven at a speed substantially faster than said predetermined velocity so that said sheet is laterally offset along said sheet path while its speed along the sheet path equals the predetermined velocity.

9. The apparatus of claim 5 additionally comprising means for selectively energizing said means for producing a lateral displacement at a plurality of predetermined lateral sheet displacements along the sheet path to provide lateral separation of sheets into a plurality of different groups, each group having a different lateral separation.

* * * * *